US005488704A

United States Patent [19]

Fujimoto

[11] Patent Number: 5,488,704

[45] Date of Patent: Jan. 30, 1996

[54] SPEECH CODEC

[75] Inventor: Mitsuo Fujimoto, Nara, Japan

[73] Assignee: Sanyo Electric Co., Ltd., Moriguchi, Japan

[21] Appl. No.: 31,808

[22] Filed: Mar. 15, 1993

[30] Foreign Application Priority Data

Mar. 16, 1992 [JP] Japan ..... 4-058078
Dec. 28, 1992 [JP] Japan ..... 4-348880

[51] Int. Cl.[6] ..... G10L 9/14

[52] U.S. Cl. ..... 395/228; 395/2.3; 395/2.31; 395/2.2; 395/2

[58] Field of Search ..... 395/2.2, 2.28, 395/2.31, 2.3

[56] References Cited

U.S. PATENT DOCUMENTS 4,667,340 5/1987 Arjmand et al. ..... 395/2.28
5,293,449 3/1994 Tzeng ..... 395/2.28
5,307,441 4/1994 Tzeng ..... 395/2.31

*Primary Examiner*—Allen R. MacDonald
*Assistant Examiner*—Tariq Hafiz
*Attorney, Agent, or Firm*—Hoffmann & Baron

[57] ABSTRACT

A speech codec includes a drive sound source generating circuit in which, in a case of a voiced sound speech, a pulse pattern signal corresponding to a pitch-scale, drive sound source signals stored within a newest predetermined past time period and a noise signal are multiplied by predetermined gains, respectively, and then, added to each other so as to generate a drive voiced sound source and, in a case of an unvoiced sound, drive sound source signals stored within a newest predetermined past time period and a noise signal are multiplied by predetermined gains, respectively, and then, added to each other so as to generate a drive unvoiced sound source.

18 Claims, 8 Drawing Sheets

SPEECH CODEC

BACKGROUND OF THE INVENTION

1. Field of the Invention

The present invention generally relates to a speech codec. More specifically, the present invention relates to a speech codec of a CELP system in which a speech signal is compressed and coded.

2. Description of the Prior Art

In recent years, researches of speech coding technique for coding a speech signal with compression are actively made, and a speech codec at low bit rate is being rapidly put into practical use in a field of communication such as a mobile communication system, and a field of speech storage.

As a speech coding system at a low bit rate being put into practice presently, a CELP system ("CODE-EXCITED LINEAR PREDICTION (CELP) HIGH-QUALITY SPEECH AT VERY LOW BIT RATES": Proc. ICASSP pp 937–940 (1985)) of a degree of 8 kbps is known, and an improvement of a VSELP system (VECTOR SUM EXCITED LINEAR PREDICTION) developed by Motorola Inc. is being tried.

A speech codec adopting the CELP system is performed in accordance with the following steps basically:

(1) a drive sound source generating step for generating a predetermined drive sound source signal, (2) a speech synthesizing step for synthesizing a speech signal on the basis of the drive sound source signal generated in the drive sound source generating step, and (3) a code outputting step for comparing a synthesized speech signal that is synthesized in the speech synthesizing step and an inputted speech signal with each other and for selectively outputting a code corresponding to a drive sound source at a timing that an error between the both is minimum.

However, it is a fact that in a speech coding system at low bit rate less than 4 kbps, a sufficient speech quality is not obtained in such the CELP system or the VSELP system. A reason is considered that a semi-periodic pitch pulse of a voiced sound in the above described step (3) can not be sufficiently reproduced, and therefore, the quality is deteriorated.

SUMMARY OF THE INVENTION

Therefore, a principal object of the present invention is to provide a novel speech codec.

Another object of the present invention is to provide a speech codec at a low bit rate, in which it is possible to sufficiently reproduce a semi-periodic pitch pulse.

In a speech codec according to the present invention, a pitch-scale of a speech is extracted from an inputted speech signal, and it is determined whether the inputted speech signal is a voiced sound or an unvoiced sound on the basis of the pitch-scale. On the basis of the pitch-scale information and information of a determination result, a drive sound source among the drive sound sources different from each other are selectively generated. In a case where the inputted speech is the voiced sound, a first drive sound source is generated by multiplying a pulse pattern signal corresponding to the pitch-scale, a drive sound source signal stored within a newest predetermined past time period and a noise signal by predetermined gains, respectively, and then, by adding the same to each other. On the other hand, in a case where the inputted speech is the unvoiced sound, a second drive sound source is generated by multiplying a drive sound source signal stored within a newest predetermined past time period and a noise signal by predetermined gains, respectively, and then, by adding the same to each other.

Thereafter, a synthesized speech signal is outputted on the basis of the first drive sound source or the second drive sound source, and the synthesized speech signal is compared with the inputted speech signal. Then, a code corresponding to a drive sound source signal at a timing that an error between the both is minimum, and a determination result of the voiced sound or the unvoiced sound are outputted.

In accordance with the present invention, by determining whether an inputted speech that is objected to coding is a voiced sound or an unvoiced sound on the basis of a predictive residual signal, it is possible to select the first drive sound source generating means for the voiced sound or the second drive sound source generating means for the unvoiced sound. Especially, a semi-periodic pitch pulse can be effectively detected at a low bit rate, and resultingly, not only reduction of an arithmetic calculation amount in the first drive sound source generating means can be expected but also it becomes possible to improve a speech quality of a reproduced speech at a low bit rate.

In another aspect of the present invention, a pitch-scale of a speech is extracted from an inputted speech signal, and a drive sound source is generated on the basis of the pitch-scale. Then, a first drive sound source is generated by multiplying a pulse pattern signal corresponding to the pitch-scale, a drive sound source signal stored within a newest predetermined past time period and a noise signal by predetermined gains, respectively, and then, by adding the same to each other, and a second drive sound source is generated by multiplying a drive sound source signal stored within a newest predetermined past time period and a noise signal by predetermined gains, respectively, and then, by adding the same to each other.

Thereafter, synthesized speech signals are respectively outputted on the basis of the first drive sound source and the second drive sound source. Then, by comparing each of the synthesized speech signals and the inputted speech signal with each other, and a code corresponding to a drive sound source signal at a timing that an error between the both is minimum, and a determination result of the voiced sound or the unvoiced sound are outputted.

In the aspect, as different from the above described aspect, determination of a kind of the inputted speech, that is, determination of the voiced sound or the unvoiced sound on the basis of a predictive residual signal is not made. More specifically, a voiced sound synthesized speech signal is generated by setting a false pitch pulse in first synthesized speech generating means, and a unvoiced sound synthesized speech signal is generated on the basis of the inputted speech in second synthesized speech generating means, and a speech signal most similar to the inputted speech among these synthesized speech signals is selected by comparing means, and therefore, it is possible to efficiently perform the coding of the speech in spite of a low bit rate.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

First Embodiment

Prior to a detailed description of the first embodiment shown in FIG. 1, in the following, processing steps executed in a speech codec according to the first embodiment will be simply described.

A first step is a pitch extracting step. That is, in the first step, a pitch-scale of a speech is extracted from an inputted speech signal.

A second step is a voiced sound/unvoiced sound determinating step. That is, in the second step, it is determined whether the inputted speech signal is a voiced sound or an unvoiced sound.

A third step is a drive sound source generating step. That is, in the third step, a drive sound source signal is selectively generated on the basis of the pitch-scale information obtained in the first step and a determination result information obtained in the second step. If the inputted speech is the voice sound, a pulse pattern signal corresponding to the pitch-scale, a drive sound source signal stored within a newest predetermined past time period, and a noise signal are multiplied by predetermined gains, respectively, and thereafter, the same are added to each other such that a first drive sound source is generated. On the other hand, in a case where the inputted speech is the unvoiced sound, a drive sound source signal stored within a newest predetermined past time period and a noise signal are multiplied by predetermined gains, respectively, and thereafter, the same are added to each other such that a second drive sound source is generated.

A fourth step is a speech synthesizing step. That is, in the fourth step, a speech signal is synthesized on the basis of the first drive sound source signal or the second drive sound source generated in the third step, and a synthesized speech signal is outputted.

A fifth step is a code outputting step. That is, in the fifth step, the synthesized speech signal obtained by executing the fourth step and the inputted speech signal are compared with each other, and a code corresponding to a drive sound source signal at a timing that an error between the both is minimum is selectively outputted, and the determination result of the voiced sound or the unvoiced sound is outputted.

Figure 1:
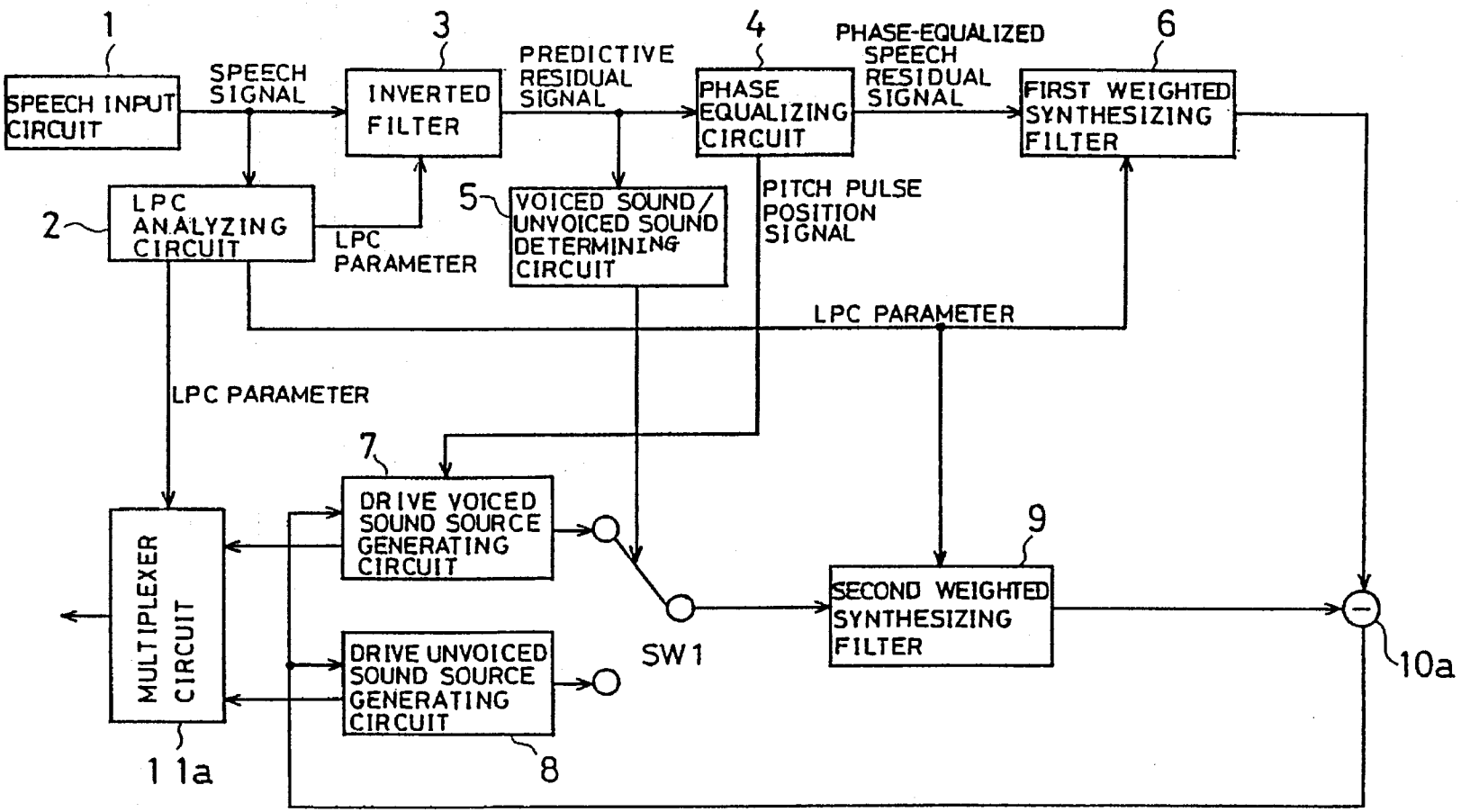
FIG. 1 is a block diagram showing a speech codec according to a first embodiment of the present invention.

With referring to FIG. 1, a speech codec according to this embodiment shown includes a speech input circuit 1 which converts a speech inputted from a microphone and etc. into a digital speech signal. The digital speech signal from the speech input circuit 1 is applied to an LPC analyzing circuit 2, and in the LPC analyzing circuit 2, an LPC parameter is evaluated by analyzing speech data of the inputted speech in accordance with linear prediction coefficient (LPC) method. The digital speech signal and the LPC parameter are applied to an inverted filter 3. The inverted filter 3 is an inverted filter which has a linear prediction type synthesizing filter function for synthesizing a speech signal that is the same as the inputted speech, and an inverted filter function. An inverted filter characteristic of the inverted filter 3 is controlled on the basis of the LPC parameter obtained by the LPC analyzing circuit 2, whereby the inverted filter 3 outputs a predictive residual signal of the inputted speech.

A phase equalizing circuit 4 is a circuit for performing a phase equalization processing of the predictive residual signal of the inputted speech that is obtained from the inverted filter 3. The phase equalizing circuit 4 makes a phase of the predictive residual signal approximately zero by falsely setting a pulse train (pitch pulse) at a position to which an energy of the speech signal is concentrated such that the speech signal can be efficiently coded. Therefore, the phase equalizing circuit 4 outputs a signal representative of a position of the above described pitch pulse and the predictive residual signal having an equalized phase.

The predictive residual signal from the inverted filter 3 is also applied to a voiced sound/unvoiced sound determinating circuit 5. The voiced sound/unvoiced sound determinating circuit 5 includes a pitch-scale calculating portion for calculating a pitch-scale of the speech on the basis of the predictive residual signal, and a voiced sound/unvoiced sound determinating portion for determinating whether the inputted speech is a voiced sound or an unvoiced sound on the basis of the predictive residual signal obtained from the inverted filter 3.

Then, a first weighted synthesizing filter 6 obtains a synthesized speech signal by utilizing the speech residual signal which has an equalized phase and obtained from the phase equalizing circuit 4 as a drive sound source. Furthermore, a drive voiced sound source generating circuit 7 generates a drive voiced sound source on the basis of a pitch pulse position signal obtained by the processing for phase equalization in the phase equalizing circuit 4, and a drive unvoiced sound source generating circuit 8 generates a drive unvoiced sound source on the basis of mainly a noise component.

Furthermore, on the basis of the LPC parameter outputted from the LPC analyzing circuit 2, and the drive voiced sound source generated by the drive voiced sound source generating circuit 7 or the drive unvoiced sound source generated by the drive unvoiced sound source generating circuit 8, a voiced sound synthesized speech or an unvoiced sound synthesized speech is produced by a second weighted synthesizing filter 9. Then, a difference between the synthesized speech signal outputted from the first weighted synthesizing filter 6 and the voiced sound synthesized speech signal or the unvoiced sound synthesized speech signal outputted from the second weighted synthesizing filter 9 is evaluated by a first differentiater 10*a*. In addition, the drive voiced sound source coded by the drive voiced sound source generating circuit 7 or the drive unvoiced sound source coded by the drive unvoiced sound source generating circuit 8 is multiplexed by a multiplexer circuit 11*a* to be outputted.

In addition, the phase equalizing circuit 4 described in the above is adapted for efficiently coding the pitch pulse position by utilizing a scale model, as discussed in a paper "Utilizing a pitch-scale in coding a phase-equalized speech"

of a collection of lecture papers of Japan Acoustics Society, September-October, 1985. An impulse response of the phase equalizing circuit 4 becomes $f(m)=e(t_0-m)$, where "e(m)" is a predictive residual sample. A reference time point $t_0$, that is, the pitch pulse position is determined one by one in accordance with the peak position of the phase-equalized residual.

In addition, in the embodiment shown, a range for searching a peak is limited to a few or several samples before and after a position separated from a just before pitch pulse position by the pitch-scale.

Figure 2:
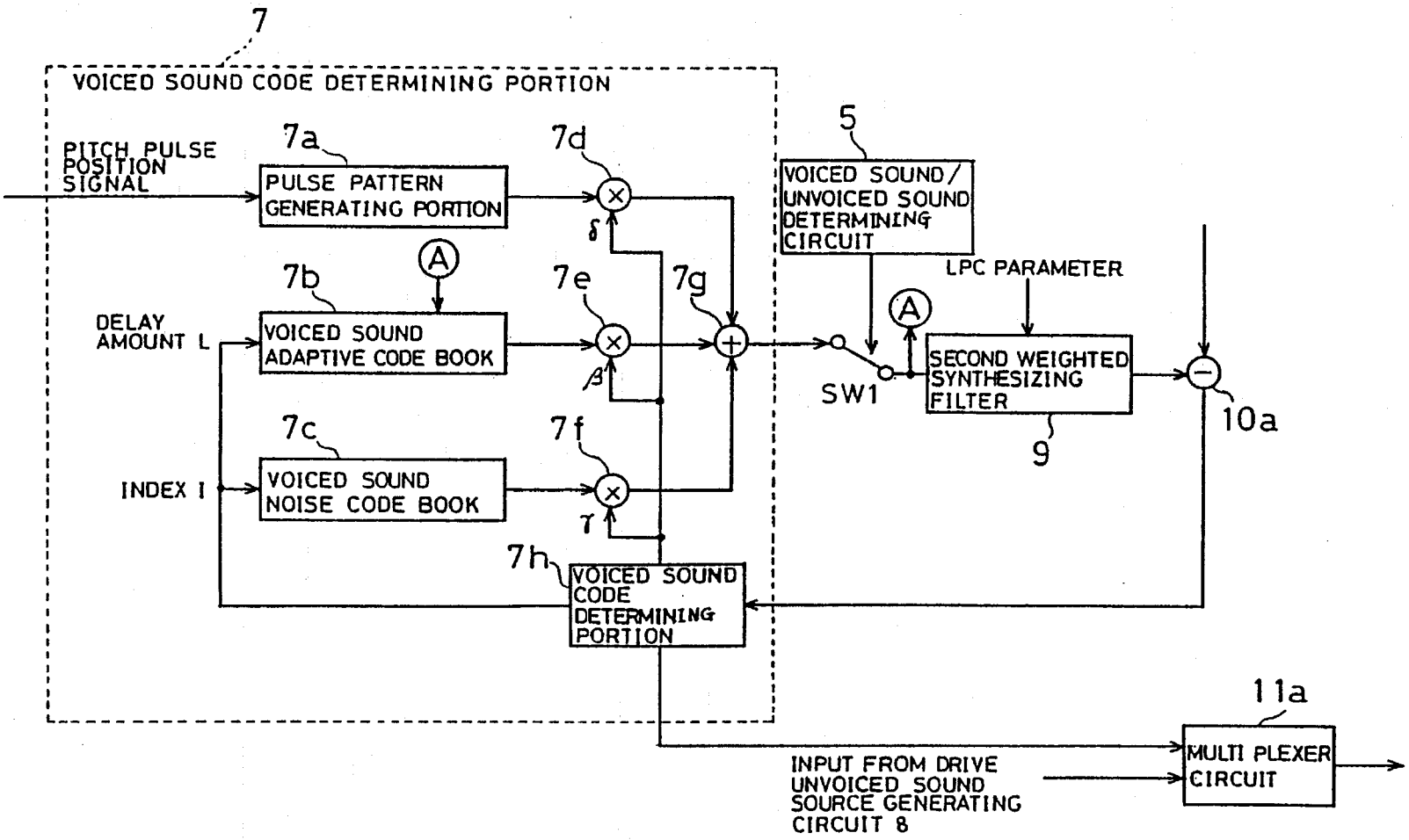
FIG. 2 is a block diagram showing a drive voiced sound source generating circuit in the first embodiment.

The drive voiced sound source generating circuit 7 which is shown in FIG. 2 and contributes to the coding the voiced sound speech mainly includes a pulse pattern generating portion 7*a*, a voiced sound adaptive code book 7*b*, a voiced sound noise code book 7*c*, and a voiced sound code determinating portion 7*h*, and generates the drive voiced sound source by multiplying respective outputs of the pulse pattern generating portion 7*a*, the voiced sound adaptive code book 7*b*, and the voiced sound noise code book 7*c* by predetermined gains, respectively, and by adding the same to each other.

The pulse pattern generating portion 7*b* generates a pitch pulse on the basis of the pitch pulse position signal outputted from the phase equalizing circuit 4. The voiced sound adaptive code book 7*b* is a kind of buffer memory for storing newest past drive sound source data, that is, output data that is obtained through addition by a first adder 7*g* within a predetermined time period. Then, the voiced sound noise code book 7*c* has a function for storing a predetermined number of plurality of noise data.

In addition, the voiced sound code determinating portion 7*h* changes or adjusts a delay amount L of the voiced sound adaptive code book 7*b*, an index I of the voiced sound noise code book 7*c* and values of gains δ, β and γ such that the difference value evaluated by the first differentiater 10*a*, specifically, a value of a square error becomes minimum. Then, the delay amount L, the index I, and the gains δ, β and γ, and the pitch pulse position signal at a timing that the difference value from the first differentiater 10*a* becomes minimum are outputted from the voiced sound code determinating portion 7*h* to the multiplexer circuit 11*a* as the coded data.

In addition, the delay amount L means a time length by which the newest past drive sound source data stored in the voiced sound adaptive code book 7*b* are shifted in time so as to effectively utilize the past drive sound source data. The index I shows an index for selecting the plurality of noise data stored in the voice sound noise code book 7*c*. Furthermore, the gains δ, β and γ are gains for respectively changing or adjusting an amplitude of the pitch pulse, an amplitude of a wave-form representative of the past drive sound source data stored in the voiced sound adaptive code book 7*b* and an amplitude of a wave-form representative of the noise data stored in the voiced sound noise code book 7*c*.

Figure 3:
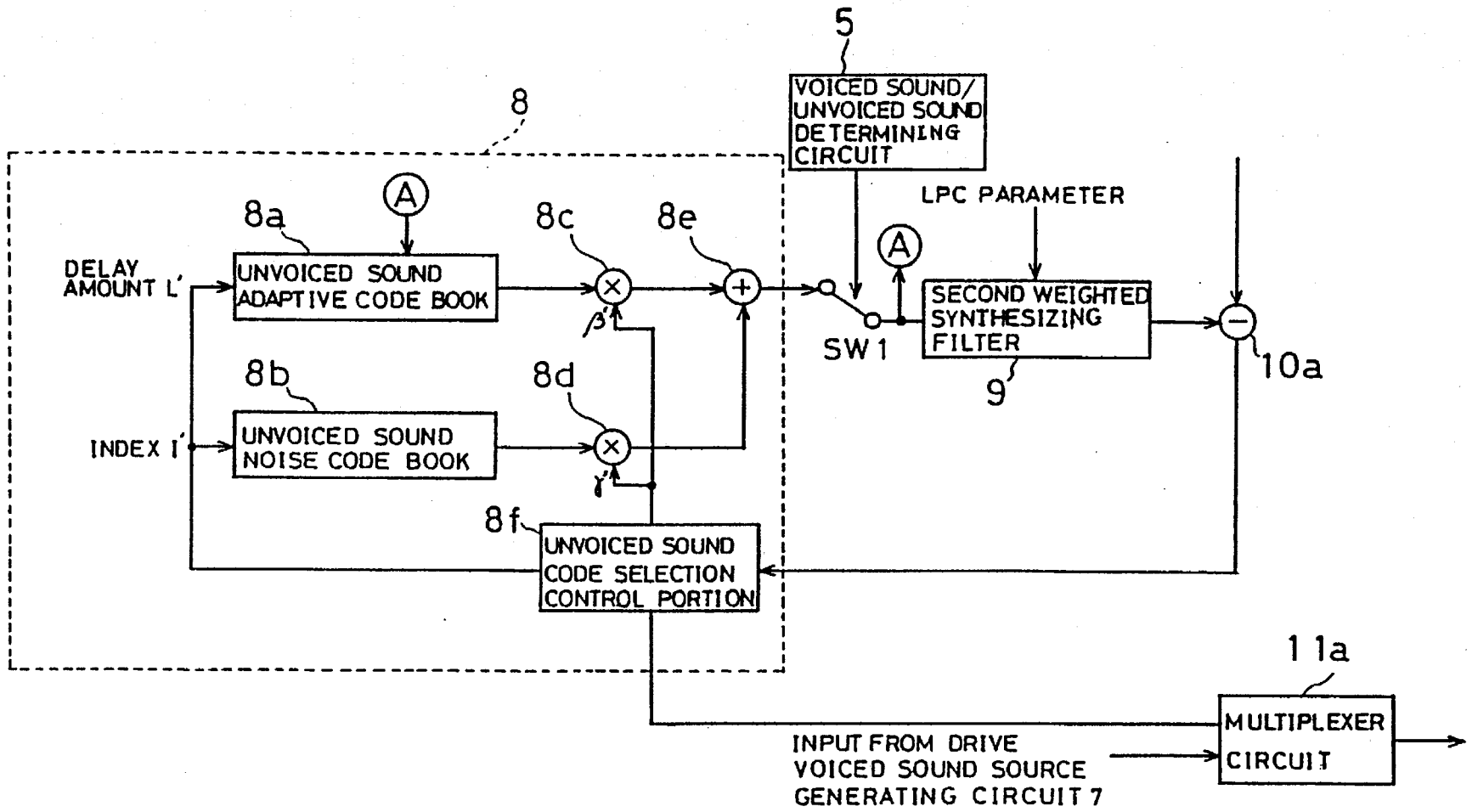
FIG. 3 is a block diagram showing a drive unvoiced sound source generating circuit in the first embodiment.

On the other hand, the drive unvoiced sound source generating circuit 8 which is shown in FIG. 3 and contributes to the coding of the unvoiced sound speech mainly includes an unvoiced sound adaptive code book 8*a*, an unvoiced sound noise code book 8*b*, and an unvoiced sound code determining portion 8*f*, and multiplies respective outputs of the unvoiced sound adaptive code book 8*a*, and the unvoiced sound noise code book 8*b* by predetermined gains, respectively, and then, adds the same to each other to generates the drive unvoiced sound source.

The unvoiced sound adaptive code book 8*a* is a kind of buffer memory for storing newest past drive sound source data, that is, output data that is obtained through addition by a second adder 8*e* within a predetermined time period. In addition, the unvoiced sound code determinating portion 8*f* changes or adjusts a delay amount L' of the unvoiced sound adaptive code book 8*a*, an index I' of the unvoiced sound noise code book 8*b* and values of gains β' and γ' such that the difference value evaluated by the first differentiater 10*a*, specifically, a value of a square error becomes minimum. Then, the delay amount L', the index I', and the gains β' and γ' at a timing that the difference value from the first differentiater 10*a* becomes minimum are outputted from the unvoiced sound code determinating portion 8*f* to the multiplexer circuit 11*a* as the coded data.

In addition, the delay amount L' means a time length by which the newest past drive sound source data stored in the unvoiced sound adaptive code book 8*a* are shifted in time so as to effectively utilize the past drive sound source data. The index I' shows an index for selecting the plurality of noise data stored in the unvoiced sound noise code book 8*b*. Furthermore, the gains β' and γ' are gains for respectively changing or adjusting an amplitude of a wave-form representative of the past drive sound source data stored in the unvoiced sound adaptive code book 8*a* and an amplitude of a wave-form representative of the noise data stored in the unvoiced sound noise code book 8*b*.

In addition, in a case of the unvoiced sound speech, since the unvoiced sound source generating circuit 8 is selected by the switch SW1, the speech codec becomes to have the same structure as that of a normal CELP.

The second weighted synthesizing filter 9 has a function for synthesizing the speech signal by receiving an output of the drive voiced sound source generating circuit 7 (FIG. 2) or the drive unvoiced sound source generating circuit 8 (FIG. 3), and the first differentiater 10*a* compares the synthesized speech signal which is synthesized by the first weighted synthesizing filter 6 and the synthesized speech signal which is synthesized by the second weighted synthesizing filter 9 with each other. Then, a synthesized speech signal from the second weighted synthesizing filter 9, which is most similar to the synthesized speech signal from the first weighted synthesizing filter 6 is specified by means of a square error minimization method, and a signal at that time becomes a drive sound source signal.

The multiplexer circuit 11*a* multiplexes the LPC parameter, the voiced sound/unvoiced sound determinating data, the delay amount L' of the unvoiced sound adaptive code book 8*a*, the index I' of the unvoiced sound noise code book 8*b*, and the values of the gains β' and γ' of the drive sound source signal thus specified, or the LPC parameter, the voiced sound/unvoiced sound determinating data, the pitch pulse position signal, the delay amount L of the voiced sound adaptive code book 7*b*, the index I of the voiced sound noise code book 7*c*, and the values of the gains δ, β and γ of the drive sound source signal thus specified, and outputs the same as the coded data.

Although the voiced sound adaptive code book 7*b*, the unvoiced sound adaptive code book 8*a*, the voiced sound noise code book 7*c* and the unvoiced sound noise code book 8*b* are basically the same as that used in the conventional CELP speech codec system, this embodiment shown is different from the prior art in a point that each of the adaptive code book and the noise code book is divided into the voiced sound code book and the unvoiced sound code book which are used properly according to the voiced sound or the unvoiced sound. Furthermore, the drive voiced sound source generating circuit 7 is provided with the pattern generating portion 7*a* additionally.

Figure 4:
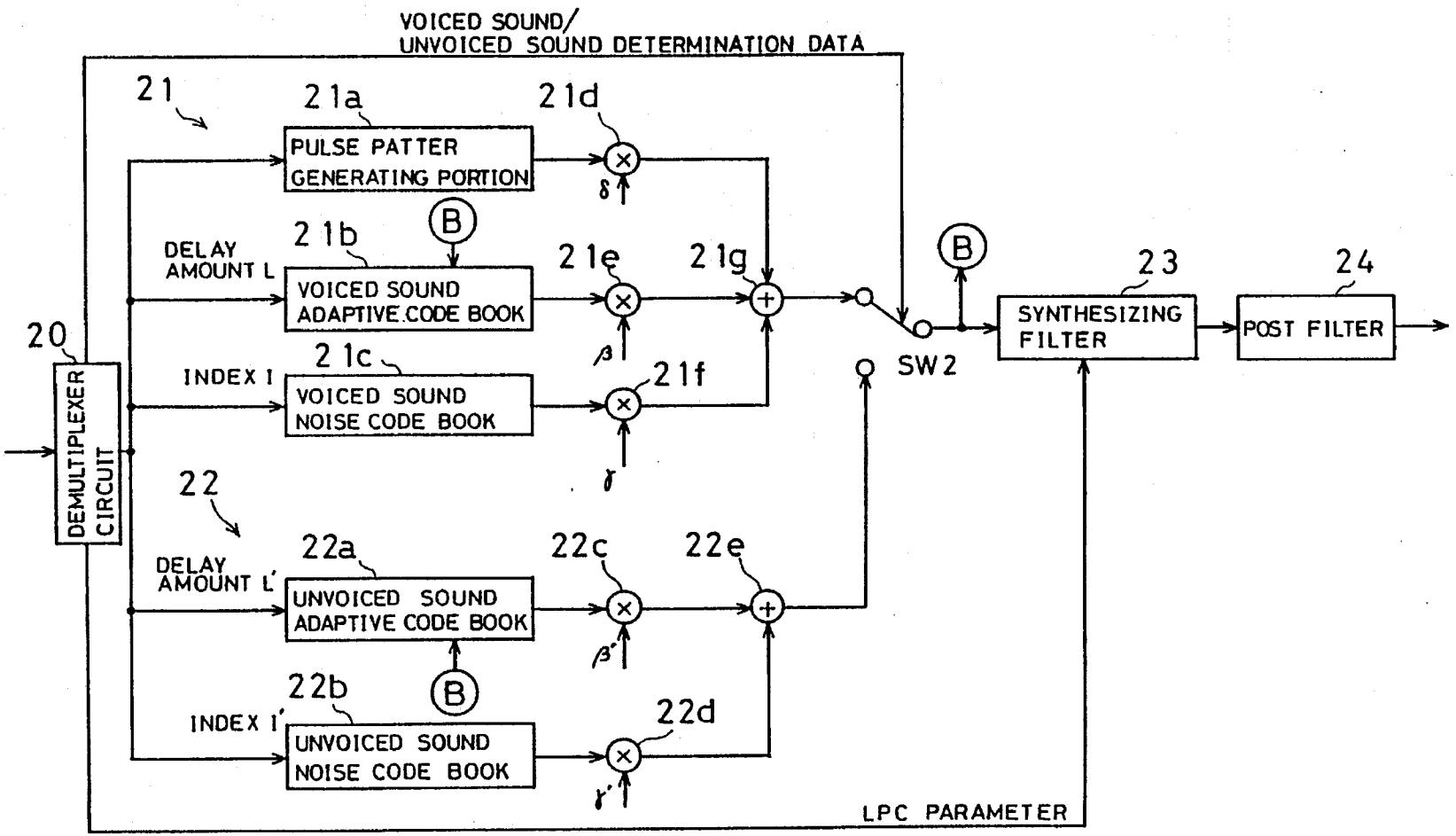
FIG. 4 is a block diagram showing a speech decoding circuit in the first embodiment.

FIG. 4 is a block diagram showing a speech decoding unit for decoding multiplexed data that is coded by the speech codec shown in FIG. 1 to FIG. 3. However, a drive voiced sound source reproducing circuit 21 and a drive unvoiced sound source reproducing circuit 22 shown in FIG. 4 respectively have the same functions as that of the drive voiced sound generating circuit 7 shown in FIG. 2 and the drive unvoiced sound source generating circuit 8 shown in FIG. 3. However, in FIG. 4, the voiced sound code determinating portion **7*h* shown in FIG. 2 and the unvoiced sound code determinating portion 8*f*** shown in FIG. 3 are not included.

With referring to FIG. 4, the multiplexed data outputted from the multiplexer circuit **11*a* of the speech codec is received by a demultiplexer circuit 20, and a filter characteristic of a synthesizing filter 23 is set on the basis of the LPC parameter outputted from the speech codec. A synthesized speech outputted from the synthesizing filter 23 is wave-shaped by a post filter 24**.

An operation wherein a speech inputted to the speech codec shown in FIG. 1 to FIG. 3 is coded and the same is decoded by the speech decoding unit shown in FIG. 4 so as to reproduce the speech will be described in the following.

At first, in FIG. 1, when the speech is inputted to the speech input circuit 1, the digital speech signal converted by the speech input circuit 1 is outputted to the LPC analyzing circuit 2 and the inverted filter 3, respectively. The LPC parameter is evaluated in the LPC analyzing circuit 2 on the basis of the LPC analyzing method, and the parameter is outputted to the inverted filter 3, the first weighted synthesizing filter 6, the second weighted synthesizing filter 9, and the multiplexer circuit **11*a*, respectively. The predictive residual signal of the inputted speech is evaluated by the inverted filter 3 on the basis of the LPC parameter that is analyzed by the LPC analyzing circuit 2, and the predictive residual signal is outputted to the phase equalizing circuit 4 and the voiced sound/unvoiced sound determinating circuit 5**, respectively.

When the predictive residual signal is inputted to the phase equalizing circuit 4 from the inverted filter 3, a false pitch pulse train is set in a position to which an energy of the speech signal is concentrated, whereby the digital speech signal is phase-equalized. The residual signal thus phase-equalized is outputted to the first weighted synthesizing filter 6, and the pitch pulse position signal representative of the position of the pulse train is outputted to the drive voiced sound source circuit 7.

On the other hand, in a case where it is determined that the speech which is inputted to the speech input circuit 1 is the voiced sound by the voiced sound/unvoiced sound determinating circuit 5 on the basis of the inputted predictive residual signal, the switch SW1 shown in FIG. 2 is switched to a side of the drive voiced sound source generating circuit 7, and in a case where it is determined that the speech inputted to the speech input circuit 1 is the unvoiced sound, the switch SW1 is switched to a side of the drive unvoiced sound generating circuit 8.

When the switch SW1 is switched to the side of the drive voiced sound source generating circuit 7, as shown in FIG. 2, the pulse pattern is generated by the pulse pattern generating portion **7*a* on the basis of the pitch pulse position signal outputted from the phase equalizing circuit 4 in the drive voiced sound source generating circuit 7, and the pulse pattern is outputted to the first multiplier 7*d*. The first multiplier 7*d* changes or adjust an amplitude of the pulse pattern by multiplying the pulse pattern by the gain δ selected by the voiced sound code determinating portion 7*h*. Furthermore, the noise data stored in the index I which is selected by the voiced sound code determinating portion 7*h* is read-out from the voiced sound noise code book 7*c*, and the third multiplier 7*f* multiplies the noise data by the gain γ selected by the voiced sound code determinating portion 7*h*. In response thereto, the first adder 7*g* adds output data of the first multiplier 7*d* and the third multiplier 7*f* to each other, and output data of the first adder 7*g* becomes the newest past drive sound source signal data, and fed-back to the voiced sound adaptive code book 7*b* to be stored therein, and outputted to the second weighted synthesizing filter 9**.

In addition, in an initial state of the voiced sound adaptive code book **7*b*, that is, a reset state thereof, no drive sound source data is stored therein, and the newest past drive sound source data becomes to be sequentially stored in the voiced sound adaptive code book 7*b* from a timing that the output of the first adder 7*g* is fed-back to the code book 7*b*** as described above.

In the second weighted synthesizing filter 9, the voiced sound synthesized speech signal is generated on the basis of the drive sound source data obtained by the first adder **7*g* and the LPC parameter outputted from the LPC analyzing portion 2, and the same is outputted to the first differentiater 10*a*. In the first differentiater 10*a*, the difference between the synthesized speech signal outputted from the first weighted synthesizing filter 6 and the voiced sound synthesized speech signal generated by the second weighted synthesizing filter 9 is evaluated, and the voiced sound code determining portion 7*h* repeatedly selects the delay amount L, the index I, and the gains δ, β and γ until the difference value becomes minimum. Accordingly, from the voiced sound adaptive code book 7*b*, the newest past drive sound source data that is delayed by the delay amount L is outputted to the second multiplier 7*e*, and the drive sound source data is multiplied by the gain β. In addition, from the voiced sound noise code book 7*c*, the noise data selected according to the index I is outputted to the third multiplier 7*f*, whereby the noise data is multiplied by the gain γ. On the other hand, the first multiplier 7*d* multiplies the pulse pattern generated by the pulse pattern generating portion 7*b* by the gain δ. Resultingly, the first adder 7*g* adds the output data of the first multiplier 7*d*, the second multiplier 7*e*, and the third multiplier 7*f* to each other, and the addition result data becomes a newest past drive sound source signal which is fed-back again to the voiced sound adaptive code book 7*b*** to be stored therein.

Then, the delay amount L of the voiced sound adaptive code book **7*b*, the index I of the voiced sound noise code book 7*c*, the gains δ, β and γ, and the pitch pulse position signal that are finally determined are respectively coded by the voiced sound code determining portion 7*h*, and outputted to the multiplexer circuit 11*a***.

Next, when the switch SW1 switched to the side of the drive unvoiced sound source generating circuit 8, as shown in FIG. 3, the noise data selected on the basis of the index I' that is selected by the unvoiced sound code determining portion **8*f* is read-out from the unvoiced sound noise code book 8*b* of the drive unvoiced sound source generating circuit 8. The fifth multiplier 8*d* multiplies the noise data by the gain γ' that is selected by the unvoiced sound code determining portion 8*f*. In response thereto, the second adder 8*e* feeds-back the output data from the fifth multiplier 8*d* to the unvoiced sound adaptive code book 8*a* as a newest past drive sound source signal such that the same can be stored therein, and the output data is applied to the second weighted synthesizing filter 9**.

In addition, in an initial state of the unvoiced sound adaptive code book **8*a*, that is, a reset state thereof, no drive sound source data is stored therein, and the newest past drive sound source data is sequentially stored in the unvoiced sound adaptive code book 8***a* from a timing that the output of the fifth multiplier 8*d* is fed-back thereto as described above.

On the other hand, in the second weighted synthesizing filter 9, the unvoiced sound synthesized speech signal is generated on the basis of the drive sound source data obtained by the second adder 8*e* and the LPC parameter outputted from the LPC analyzing portion 2, and the same is outputted to the first differentiater 10*a*. In the first differentiater 10*a*, the difference between the synthesized speech signal outputted from the first weighted synthesizing filter 6 and the unvoiced sound synthesized speech signal generated by the second weighted synthesizing filter 9 is evaluated, and the unvoiced sound code determining portion 8*f* repeatedly selects the delay amount L', the index I', and the gains β' and γ' until the difference value becomes minimum. Accordingly, from the unvoiced sound adaptive code book 8*a*, the newest past drive sound source data that is delayed by the delay amount L' is outputted to the fourth multiplier 8*c*, and the drive sound source data is multiplied by the gain β'. In addition, in the unvoiced sound noise code book 8*b*, the noise data selected according to the index I' is outputted to the second multiplier 8*e*, whereby the noise data is multiplied by the gain γ'. Resultingly, the second adder 8*e* adds the output data of the fourth multiplier 8*c* and the fifth multiplier 8*d* to each other, and the addition result data becomes a newest past drive sound source signal, which is fed-back again to the unvoiced sound adaptive code book 8*a* to be stored therein.

Then, the delay amount L' of the unvoiced sound adaptive code book 8*a*, the index I' of the unvoiced sound noise code book 8*b*, the gains β' and γ' that are finally determined are respectively coded by the unvoiced sound code determining portion 8*f*, and outputted to the multiplexer circuit 11*a*.

Thus, the multiplexer circuit 11*a* outputs the LPC parameter inputted from the LPC analyzing circuit 2, and the voiced sound/unvoiced sound determinating data inputted from the voiced sound/unvoiced sound determinating circuit 5 together with the coded data composed of the delay amount L, the index I, the gains δ, β and γ, and the pitch pulse position signal that are outputted from the drive voiced sound source generating circuit 7, or the coded data composed of the delay amount L', the index I', and the gains β' and γ' that are outputted from the drive unvoiced sound source generating circuit 8 to a demultiplexer circuit 20 of the speech decoding unit described later.

A decoding system for decoding the multiplexed data that is thus outputted from the multiplexer circuit 11*a* will be described with reference to FIG. 4. When the multiplexed data is inputted to the demultiplexer circuit 20 from the multiplexer circuit 11*a*, the demultiplexer circuit 20 outputs a command for switching the switch SW2 to a side of the drive voiced sound source reproducing circuit 21 in response to the voiced sound/unvoiced sound determinating data if the multiplexed data contains the determinating data representing that the inputted speech is the voiced sound.

In addition, in an initial state (reset state), the noise data the same as that of the voiced sound noise code book 7*c* and the unvoiced sound noise code book 8*b* are stored in advance in the voiced sound noise code book 21*c* and the unvoiced sound noise code book 22*b*; however, no drive sound source data is stored in the voiced sound adaptive code book 21*b* and the unvoiced sound adaptive code book 22*a*.

In a case where the switch SW2 is switched to the side of the drive voiced sound source reproducing circuit 21, when the multiplexed data is inputted to the demultiplexer circuit 20, the pitch pulse position signal, the delay amount L, and the index I included in the multiplexed data are inputted to the pulse pattern generating portion 21*a*, the voiced sound adaptive code book 21*b*, and the voiced sound noise code book 21*c*, respectively, and the gains δ, β and γ are inputted to the sixth multiplier 21*d*, the seventh multiplier 21*e* and the eighth multiplier 21*f*, respectively.

The pulse pattern generating portion 21*a* generates a pulse pattern on the basis of the pitch pulse position signal, and the pulse pattern is outputted to the sixth multiplier 21*d* in which the pulse pattern is multiplied by the gain δ of the multiplexed data so that the amplitude of the pulse pattern is changed or adjusted. At the same time, the voiced sound noise code book 21*c* outputs the noise data to the eighth multiplier 21*f* on the basis of the index I, and the eighth multiplier 21*f* multiplies the noise data by the gain γ of the multiplexed data to change or adjust the amplitude thereof. The third adder 21*g* adds output data of the sixth multiplier 21*d* and the eighth multiplier 21*f* to each other. Output data of the third adder 21*g* is stored in the voiced sound adaptive code book 21*b* if the switch SW2 is switched to the side of the drive voiced sound source reproducing circuit 21.

Therefore, the drive voiced sound source reproducing circuit 21 finally outputs decoded data corresponding to the multiplexed data to the synthesizing filter 23 by adding respective outputs of the sixth multiplier 21*d*, the seventh multiplier 21*e*, and the eighth multiplier 21*f* to each other by means of the third adder 21*g*. The voiced sound speech signal is reproduced by the synthesizing filter 23 on the basis of the LPC parameter, which is then wave-shaped by the post filter 24 to be outputted to a speaker or the like (not shown).

Next, in a case where the switch SW2 is switched to a side of the drive unvoiced sound source reproducing circuit 22, when the multiplexed data is inputted to the demultiplexer circuit 20, the delay amount L', and the index I' included in the multiplexed data are inputted to the unvoiced sound adaptive code book 22*a*, and the unvoiced sound noise code book 22*b*, respectively, and the gains β' and γ' are inputted to the ninth multiplier 22*c* and the tenth multiplier 22*d*, respectively.

The unvoiced sound noise code book 22*b* outputs the noise data to the tenth multiplier 22*d* on the basis of the index I', and the tenth multiplier 22*d* multiplies the noise data by the gain γ' of the multiplexed data to change or adjust the amplitude thereof. Output data of the eleventh adder 22*e* is fed-back to the unvoiced sound adaptive code book 22*a* to be rewritten and stored therein.

Therefore, the drive unvoiced sound source reproducing circuit 22 finally outputs decoded data corresponding to the multiplexed data to the synthesizing filter 23 by adding respective outputs of the ninth multiplier 22*c*, and the tenth multiplier 22*d* to each other by means of the eleventh adder 22*e*. The unvoiced sound speech signal is reproduced by the synthesizing filter 23 on the basis of the LPC parameter, which is wave-shaped by the post filter 24 to be outputted to a speaker or the like (not shown).

In addition, bit allotment of the information utilized in the speech codec shown in FIG. 1 is shown in the following table 1.

TABLE 1

| | bit allotment (bit) | |
|---|---|---|
| LPC parameter information | 24 | |
| residual power information | 4 | |
| voiced sound/unvoiced sound information | 1 | |
| | voiced sound (bit) | unvoiced sound (bit) |
| pulse position information | 38 | — |
| pulse amplitude information | 3 | — |
| adaptive code book information | 15 | 35 |
| noise code book information | 30 | 45 |
| gain information | 45 | 50 |

These information are transmitted to the speech decoding unit shown in FIG. 4 such that the speech is decoded and reproduced.

Figure 5:
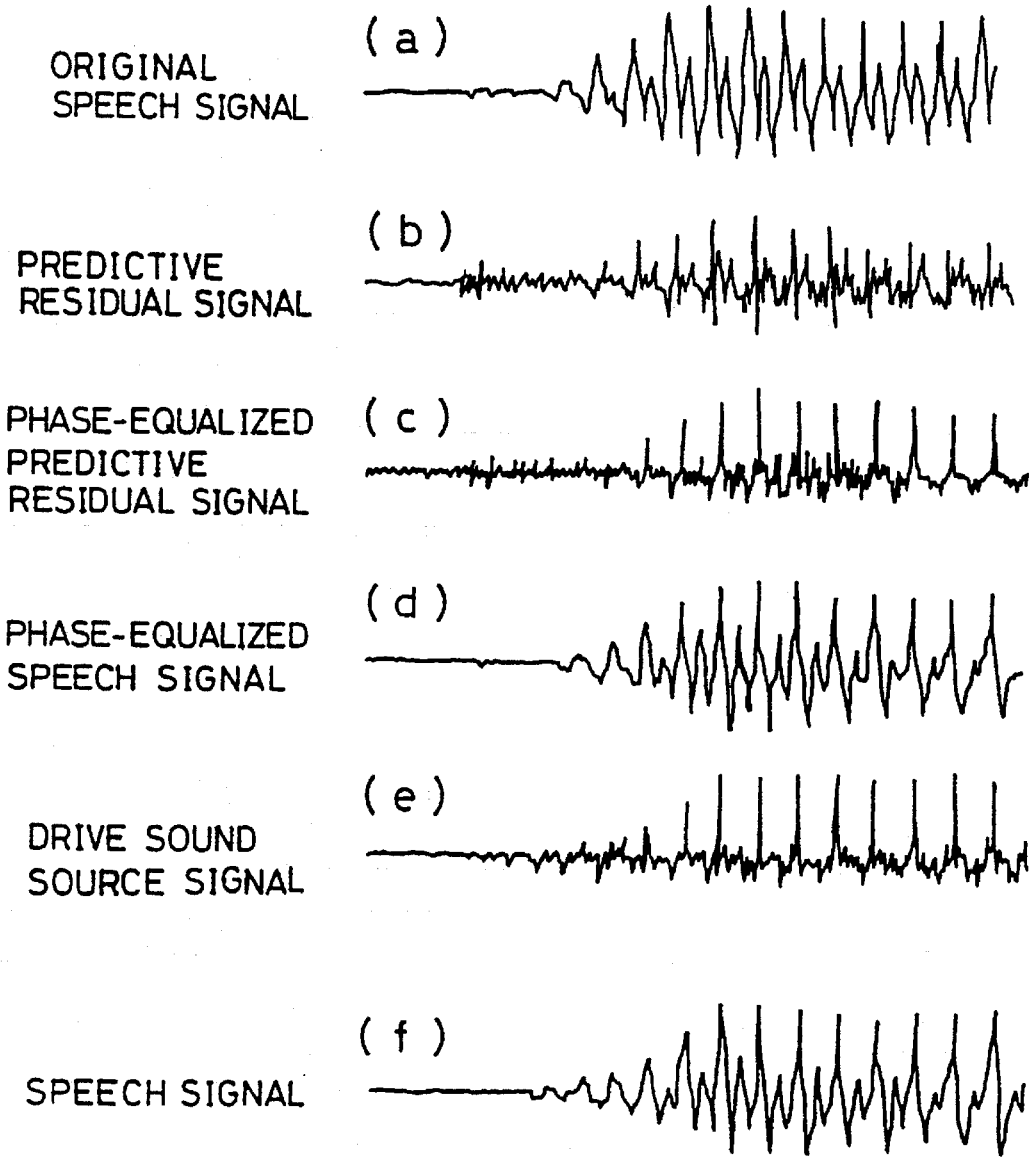
FIG. 5 is a wave-form chart showing respective signals processed in the first embodiment.

FIG. 5 shows signal wave-forms in respective steps in the first embodiment. That is, FIG. 5(*a*), FIGS. 5(*b*), FIG. 5(*c*), FIG. (*d*), FIG. 5(*e*) and FIG. (*f*) show the original speech signal, the predictive residual signal, the phase-equalized residual signal, the phase-equalized speech signal, the drive sound source (signal), and the decoded speech signal, respectively. In accordance with FIG. 5(*c*), it will be understood that the power of the predictive residual signal is concentrated to the pitch pulse due to the phase equalization in the phase equalizing circuit 4.

The pitch-scale that is necessary information for FIG. 1 embodiment selects the succeeding pulse position in the vicinity of a position separated from the preceding pulse position of the drive sound source by the pitch-scale. For example, in a case of 8 kHz sampling, the succeeding pulse position at which the amplitude of the residual signal shown in FIG. 5(*b*) becomes larger than the predetermined value is selected within a range of before and after 3 samples, respectively. In this case, when a value of a second largest sample is less than 50% of a value of a maximum sample in the residual signals of 7 samples in total, since a peak can be clearly determined, the maximum sample position is determined as the pitch pulse position. However, when the value of the second largest sample is not less than 50% of the value of the maximum sample, since it is not recognized that the peak is remarkable, the sample position of the peak showing a maximum value is determined as the succeeding pitch pulse position within the 7 samples of the residual signals after phase-equalized shown in FIG. 5(*c*). Therefore, an interval between the former pitch pulse and the latter pitch pulse becomes the pitch-scale.

In addition, the voiced sound adaptive code book 7*b* utilized in the drive voiced sound source generating circuit 7 and the unvoiced sound adaptive code book 8*a* utilized in the drive unvoiced sound source generating circuit 8 are memories each of which is a form of a shift register sequentially storing new past 146 samples in a case of 8 khz sampling, for example. However, in the voiced sound adaptive code book 7*b*, especially, any one of the drive sound source signal train within the time range of before and after 3 samples, that is, 7 samples in total in the vicinity of the position separated from the preceding pitch pulse position of the drive sound source by the pitch-scale is selectively used in a case of 8 kHz sampling, for example. In comparison therewith, in a case of the unvoiced sound, as similar to the conventional CELP, any one of the drive sound source signal is to be selected within the drive sound source signal train of 127 samples from 20-th sample to 146-th sample of the unvoiced sound adaptive code book 8*b*.

Next, a speech codec system according to the present invention will be evaluated by simulation. In evaluating, conditions for simulation are as follows: The sampling period is 8 kHz, a frame length is 40 milliseconds, a subframe length is 8 milliseconds, a bit rate is 4 kbps, and the bit allotment shown in the table 1.

Under such the conditions, the LSP coefficient is evaluated as a short time predictive coefficient, and after an interpolation for each subframe, the same is converted into the LPC coefficient. In addition, the LSP coefficient is subjected to a multistage vector quantization of 3 stages. In addition, in a case of the voiced sound, the drive vector is vector-quantized together with the gain thereof and the phase-equalized pulse sound source for each subframe. Furthermore, the search range in the voiced sound adaptive code book 7*b* for the voiced sound speech is limited to the vicinity of the pitch-scale. In this case, the drive sound source wave-form is shown in FIG. 5(*e*), and the decoded speech wave-from is shown in FIG. 5(*f*). Thus, it will be understood that the semi-periodic pitch pulse can be effectively reproduced by adopting the sound source of the phase-equalized pulse.

As an objective evaluation, segmental SNR is evaluated for 4 Japanese short sentences of men and women at a time that the phase-equalized speech is used as reference. As a result, 9.57 dB by male voice, 9.69 dB by a female voice, and 9.63 dB in average are obtained. When an audition to such the decoded speech is made, the pitch is effectively reproduced, and thus, the decoded speech having a higher degree of the nature is obtainable.

Second Embodiment

The second embodiment according to the present invention will be described with referring to FIG. 6 to FIG. 8. However, by assigning the same reference numerals to components as the same as or similar to the components of the first embodiment, a description thereof will be omitted here.

A point that the second embodiment is largely different from the first embodiment is that structure of the speech codec is simplified in comparison with that of the first embodiment by omitting the voiced sound/unvoiced sound determinating portion 5 for determinating the voiced sound or the unvoiced sound of the speech on the basis of the predictive residual signal which is processed by the inverted filter 3.

Steps executed in the second embodiment are as follow:

A first step is a pitch extracting step. That is, in the first step, a pitch-scale of a speech is extracted from an inputted speech signal.

A second step is a drive sound source generating step. That is, in the second step, a drive sound source signal is generated on the basis of the pitch-scale information obtained in the first step. More specifically, a first drive sound source is generated by multiplying a pulse pattern signal corresponding to the pitch-scale, a drive sound source signal stored within a newest predetermined past time period, and a noise signal by predetermined gains, respectively, and a second drive sound source is generated by multiplying a drive sound source signal stored within a newest predetermined past time period and a noise signal by predetermined gains, respectively.

A third step is a speech synthesizing step. That is, in the third step, a speech signal is synthesized on the basis of the first drive sound source signal or the second drive sound source generated in the third step, and a synthesized speech signal is outputted.

A fourth step is a code outputting step. That is, in the fourth step, the synthesized speech signal obtained by executing the fourth step and the inputted speech signal are compared with each other, and a code corresponding to a drive sound source signal at a timing that an error between the both is minimum is selectively outputted, and a determination result of the voiced sound or the unvoiced sound is outputted.

Figure 6:
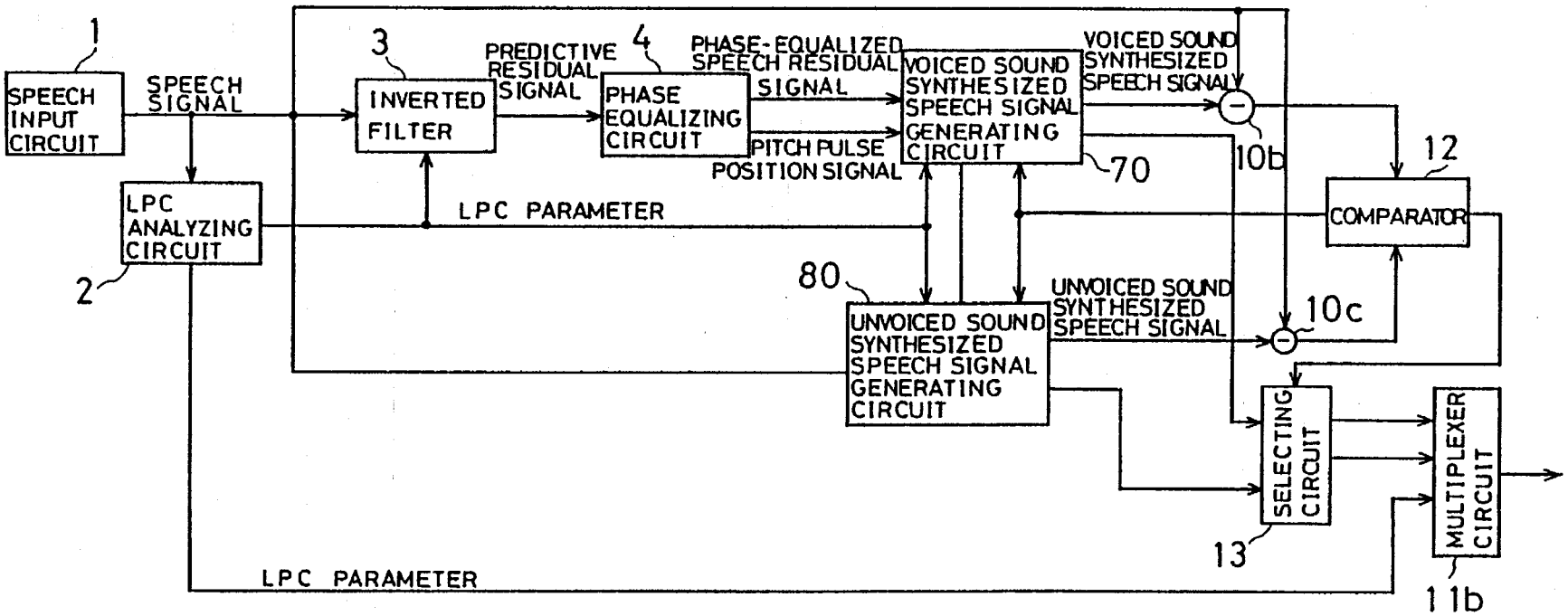
FIG. 6 is a block diagram showing a speech codec according to a second embodiment of the present invention.

With referring to FIG. 6, the comparator 12 compares difference values respectively outputted from the second differentiater 10*b* and the third differentiater 10*c* with each other, and outputs a comparison result. In addition, the voiced sound synthesized speech signal outputted from the voiced sound synthesized speech signal generating circuit 70 or the unvoiced sound synthesized speech signal outputted from the unvoiced sound synthesized speech signal generating circuit 80 is selected by the selecting circuit 13 on the basis of the difference value outputted from the comparator 12. The multiplexer circuit 11*b* outputs the multiplexed data on the basis of the voiced sound synthesized speech signal or the unvoiced sound synthesized speech signal selected by the selecting circuit 13, and the LPC parameter converted by the LPC analyzing circuit 2. Therefore, the multiplexer circuit 11*b* can perform the coding of the speech inputted to the speech input circuit 1.

Figure 7:
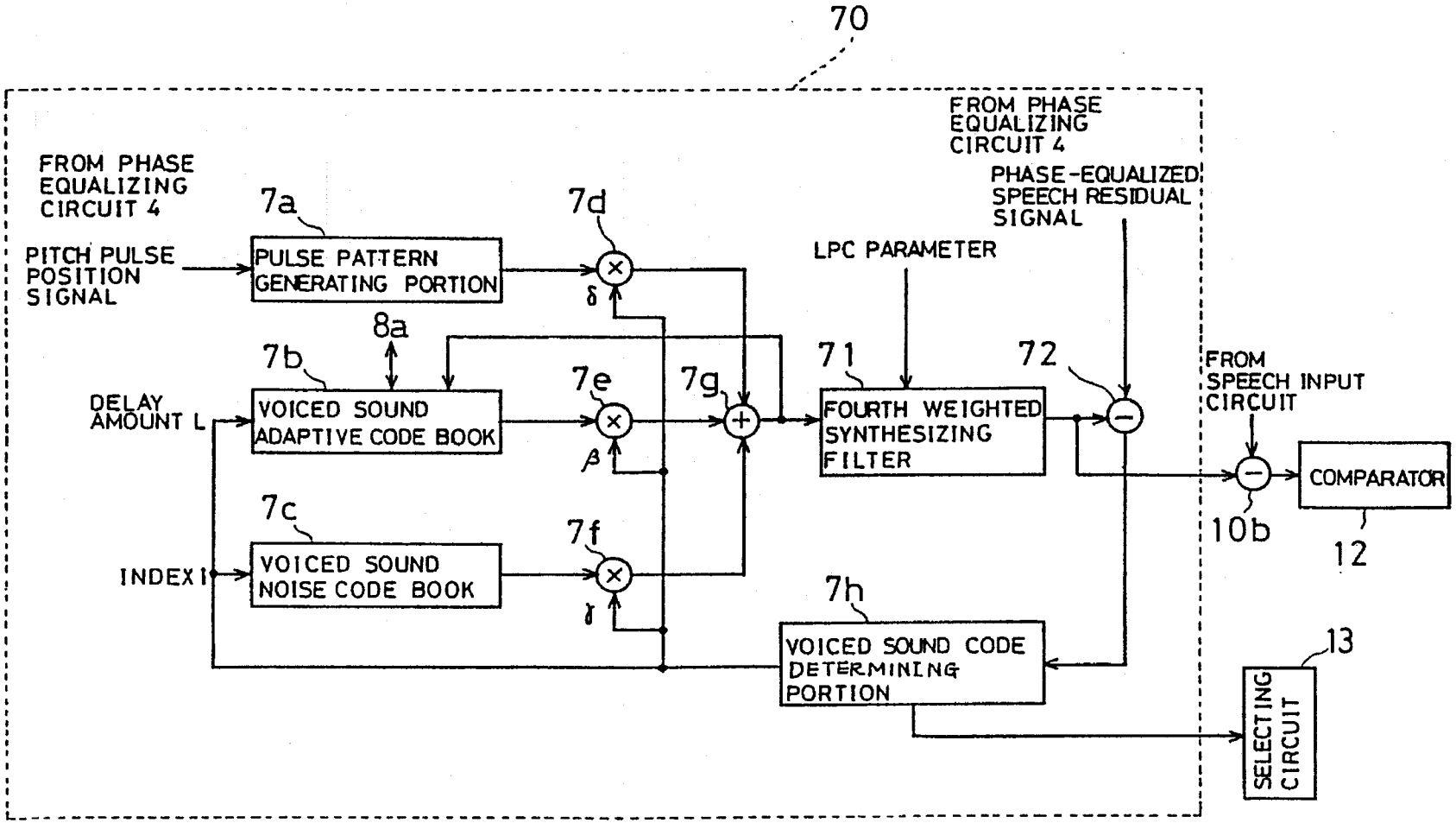
FIG. 7 is a block diagram showing a drive voiced sound source generating circuit in the second embodiment.

Structure of the voiced sound synthesized speech signal generating circuit 70 shown in FIG. 7 is basically the same as the structure of the drive voiced sound source generating circuit 7 shown in FIG. 2; however, the former is different from the latter in a point that the following components are added.

(1) A fourth weighted synthesizing filter 71 for synthesizing the voiced sound synthesized speech signal on the basis of the LPC parameter outputted from the LPC analyzing circuit 2 and the drive sound source signal generated by the first adder 7*g*; and (2) A fourth differentiater 72 for obtaining a difference between the residual signal that is outputted from the phase equalizing circuit 4 and has the equalized phase, and the voiced sound synthesized speech signal outputted from the fourth synthesizing filter 71, and for outputting a difference value.

Figure 8:
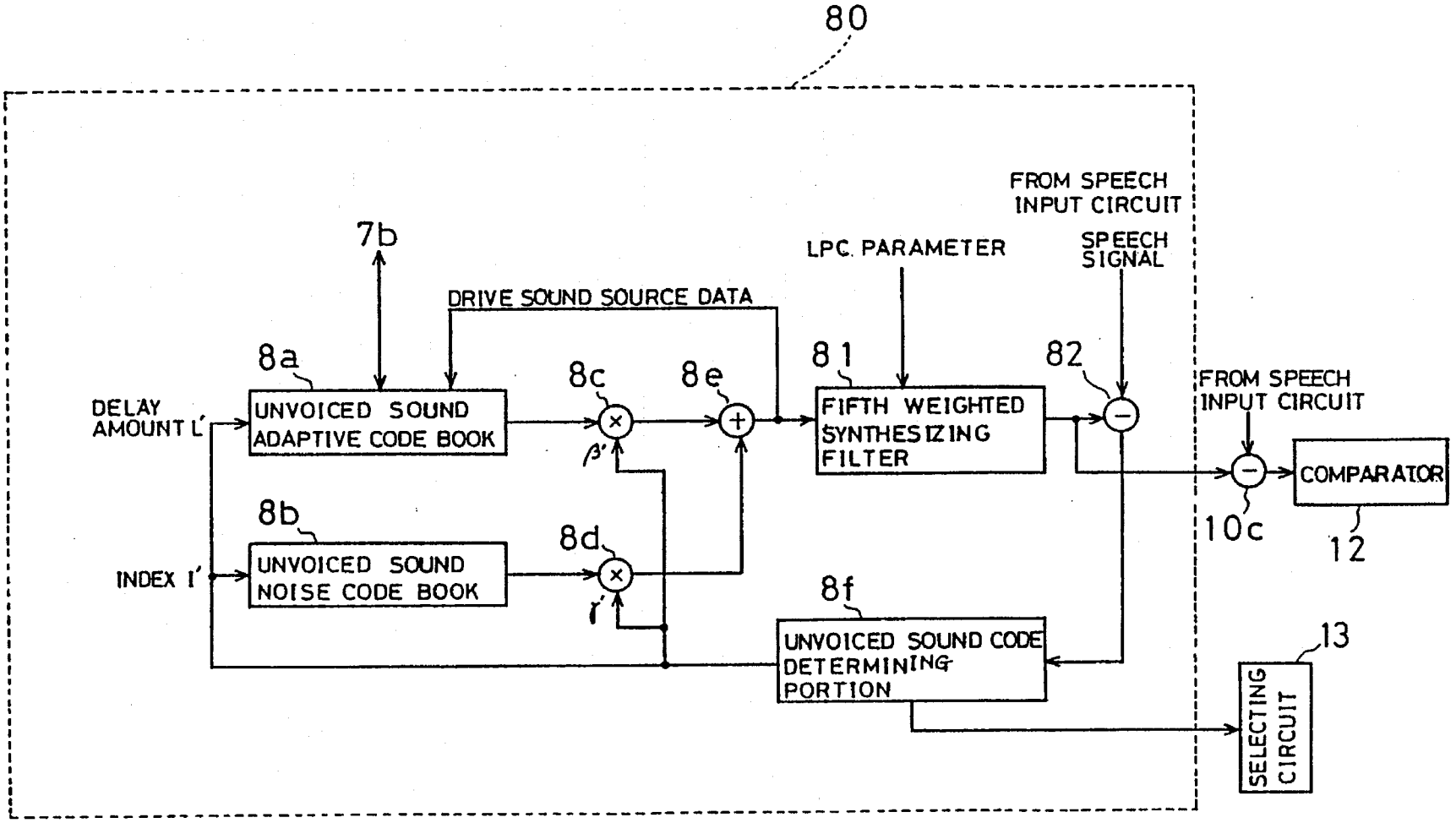
FIG. 8 is a block diagram showing a drive unvoiced sound source generating circuit in the second embodiment.

Structure of the unvoiced sound synthesized speech signal generating circuit 80 shown in FIG. 8 is basically the same as the structure of the drive unvoiced sound source generating circuit 8 shown in FIG. 3; however, the former is different from the latter in a point that the following components are added.

(1) A fifth weighted synthesizing filter 81 for synthesizing the unvoiced sound synthesized speech signal on the basis of the LPC parameter outputted from the LPC analyzing circuit 2 and the drive sound source signal generated by the second adder 8*e*; and (2) A third differentiater 82 for obtaining a difference between the speech signal inputted to the speech input circuit 1 and the unvoiced sound synthesized speech signal outputted from the fifth synthesizing filter 81, and for outputting a difference value.

In the speech codec shown in FIG. 6 to FIG. 8, in a case where the inputted speech is coded, when the speech is inputted to the speech input circuit 1, the digital speech signal converted by the speech input circuit 1 is outputted to the LPC analyzing circuit 2, the inverted filter 3, the unvoiced sound synthesized speech signal generating circuit 80, the second differentiater 10*b*, and the third differentiater 10*c*, respectively.

The LPC parameter is evaluated in the LPC analyzing circuit 2 on the basis of the LPC analyzing method, and the LPC parameter is outputted in the inverted filter 3, the voiced sound synthesized speech signal generating circuit 70, the unvoiced sound synthesized speech signal generating circuit 80, and the multiplexer circuit 11*b*, respectively. In the inverted filter 3, the predictive residual signal of the inputted speech is evaluated on the basis of the LPC parameter analyzed by the LPC analyzing circuit 2.

On the other hand, when the predictive residual signal from the inverted filter 3 is outputted to the phase equalizing circuit 4, as similar to the first embodiment, the false pitch pulse train is set in the position to which the energy of the predictive residual signal is concentrated, whereby the speech residual signal that is phase-equalized and the pitch pulse position signal representative of the position of the pulse train are inputted to the voiced sound synthesized speech signal generating circuit 70.

In the voiced sound synthesized speech signal generating circuit 70 as shown in FIG. 7, the pulse pattern is generated by the pulse pattern generating portion 7*a* on the basis of the pitch pulse position signal outputted from the phase equalizing circuit 4. The pulse pattern is applied to the first multiplier 7*d* which changes or adjusts the amplitude of the pulse pattern by multiplying the pulse pattern by the gain $\delta$ selected by the voiced sound code determinating portion 7*h*. The noise data is read-out from the voiced sound noise code 7*c* on the basis of the index I selected by the voiced sound code determinating portion 7*h*, and the third multiplier 7*f* multiplies the noise data by the gain $\gamma$ selected by the voiced sound code determinating portion 7*h*. The first adder 7*g* adds output data of the first multiplier 7*d* and the third multiplier 7*f* to each other, and an addition result is fed-back to the voiced sound adaptive code book 7*b* to be stored therein as the newest past drive sound source data, and also outputted to the fourth weighted synthesizing filter 71.

In addition, in an initial state of the voiced sound adaptive code book 7*b*, that is, a reset state thereof, no drive sound source data is stored therein, and the newest past drive sound source data is sequentially stored in the voiced sound adaptive code book 7*b* from a timing that the output of the first adder 7*g* is fed-back thereto as described above.

On the other hand, the voiced sound synthesized speech signal is generated by the fourth weighted synthesizing filter 71 on the basis of drive sound source data obtained by the first adder 7*g*, and the LPC parameter outputted from the LPC analyzing circuit 2, and the same is outputted to the fourth differentiater 72. The fourth differentiater 72 evaluates the difference between the speech residual signal that is phase-equalized and outputted from the phase equalizing circuit 4 and the voiced sound synthesized speech signal generated by the fourth weighted synthesizing filter 71, and the voiced sound code determinating portion 7*h* properly selects the delay amount L, the index I, and the gains $\delta$, $\beta$ and $\gamma$ such that the difference value becomes minimum. In response thereto, the newest past drive sound source data that is delayed by the delay amount L is outputted to the second multiplier 7*e*, and the drive sound source data is multiplied by the gain $\beta$. In addition, the noise data that is selected by the index I is outputted from the voiced sound noise code book 7*c* to the third multiplier 7*f*, and the noise data is multiplied by the gain $\gamma$. Furthermore, the pulse pattern generated by the pulse pattern generating portion 7*a* is multiplied by the gain $\delta$ in the first multiplier 7*d*.

Thereafter, the first adder 7g adds output data of the first multiplier 7d, the second multiplier 7e, and the third multiplier 7f to each other, and the addition result data is fed-back again to the voiced sound adaptive code book 7b to be stored therein as the newest past drive sound source data, and the same is outputted to the fourth weighted synthesizing filter 71. The voiced sound synthesized speech signal generated by the fourth weighted synthesizing filter 71 is outputted to the fourth differentiater 72.

When the difference value becomes minimum in the fourth differentiater 72, the voiced sound code determining portion 7h stops selecting the delay amount L, the index I, and the gain δ, β and γ, whereby the voiced sound synthesized speech signal generated on the basis of the pitch pulse position signal, the delay amount L, the index I, and the gains δ, β and γ that are thus finally determined is outputted to the second differentiater 10b. Then, the second differentiater 10b evaluates the difference between the speech signal outputted from the speech input circuit 1 and the voiced sound synthesized speech signal outputted from the fourth weighted synthesizing filter 71 is evaluated, and the difference value is inputted to the comparator 12.

On the other hand, the newest past drive sound source signal data is read-out from the unvoiced sound adaptive code book 8a in the unvoiced sound synthesized speech signal generating circuit 80 shown in FIG. 8 on the basis of the delay amount L', and the fourth multiplier 8c multiplies the drive sound source data by the gain β' selected by the unvoiced sound code determinating portion 8f. Furthermore the noise data is read-out from the unvoiced sound noise code book 8b on the basis of the index I' selected by the unvoiced sound code determinating portion 8f, and the fifth multiplier 8d multiplies the noise data by the gain γ' selected by the unvoiced sound code determinating portion 8f. The second adder 8e adds the output data of the fourth multiplier 8c and the fifth multiplier 8d to each other, and the addition result data is fed-back to the unvoiced sound adaptive code book 8a to be stored therein as the newest past drive sound source data, and the same is also outputted to the fifth waited synthesizing filter 81.

In addition, in an initial state (reset state), no drive sound source data is stored in the unvoiced sound adaptive code book 8a, and the newest past drive sound source data is sequentially stored in the unvoiced sound adaptive code book 8a from a timing that the output data of the second adder 8e is fed-back thereto.

In the fifth synthesizing filter 81, the unvoiced sound synthesized speech signal is generated on the basis of the drive sound source signal obtained by the second adder 8e and the LPC parameter outputted from the LPC analyzing portion 2, and the same is outputted to the fifth differentiater 82. The fifth differentiater 82 evaluates the difference between the speech signal outputted from the speech input circuit 1 and the unvoiced sound synthesized speech signal generated by the fifth waited synthesizing filter 81, and the unvoiced sound code determinating portion 8f selects the delay amount L', the index I', and the gain β' and γ' until the difference value becomes minimum. Therefore, the newest past drive sound source data that is delayed by the delay amount L' is outputted from the unvoiced sound adaptive code book 8a to the fourth multiplier 8c in which the newest past drive sound source data is multiplied by the gain β'. Furthermore, the noise data that is selected by the index I' is outputted from the unvoiced sound noise code book 8b to the fifth multiplier 8d in which the noise data is multiplied by the gain γ'.

Thereafter, the second adder 8e adds the output data of the fourth multiplier 8c and the fifth multiplier 8d to each other, and the addition result data is fed-back again to the unvoiced sound adaptive code book 8a to be stored therein as the newest past drive sound source data, and the same is outputted to the fifth weighted synthesizing filter 81. The unvoiced sound synthesized speech signal generated by the fifth weighted synthesizing filter 81 is outputted to the fifth differentiater 82.

When the difference value becomes minimum in the fifth differentiater 82, the unvoiced sound code determining portion 8f stops selecting the delay amount L', the index I', and the gain β' and γ', whereby the unvoiced sound synthesized speech signal generated on the basis of the delay amount L', the index I', and the gains β' and γ' that are thus finally determined is outputted to the third differentiater 10c. Then, the third differentiater 10c evaluates the difference between the speech signal outputted from the speech input circuit 1 and the unvoiced sound synthesized speech signal outputted from the fifth weighted synthesizing filter 81, and the difference value is inputted to the comparator Thus, the voiced sound synthesized speech signal and the unvoiced sound synthesized speech signal are generated by the voiced sound synthesized speech signal generating circuit 70 and the unvoiced sound synthesized speech signal generating circuit 80, respectively. Then, the comparator 12 compares the difference values from the second differentiater 10b and the third differentiater 10c with each other, and outputs the selection signal to the selecting circuit 13 so as to select the speech signal with a small difference value.

If and when the difference value of the voiced sound synthesized speech signal is smaller than that of the unvoiced sound synthesized speech signal, the comparator 12 outputs a command for commanding to copy the drive sound source data stored in the voiced sound adaptive code book 7b into the unvoiced sound adaptive code book 8a of the unvoiced sound synthesized speech signal generating circuit 80. Thus, the drive sound source data having the same contents are always stored in both of the voiced sound adaptive code book 7b and the unvoiced sound adaptive code book 8a.

In contrast, when the difference value of the unvoiced sound synthesized speech signal is smaller than that of the voiced sound synthesized speech signal, the comparator 12 outputs a command for commanding to copy the drive sound source data stored in the unvoiced sound adaptive code book 8a into the voiced sound adaptive code book 7b of the voiced sound synthesized speech signal generating circuit 70. Thus, the drive sound source data having the same contents is always stored in both of the unvoiced sound adaptive code book 8a and the voiced sound adaptive code book 7b. The reason why the contents stored in one adaptive code book are copied into the other adaptive code book is the same as that of the first embodiment, and therefore, is not described here.

The pitch pulse position signal, the delay amount L, the index I and the gains δ, β and γ, and the delay amount L', the index I' and the gains β' and γ' are outputted from the voiced sound synthesized speech signal generating circuit 70 and the unvoiced sound synthesized speech signal generating circuit 80, respectively, and the selecting circuit 13 receives the selection signal representing that any one of the signals outputted from the comparator 12 is to be selected, and performs the coding of the pitch pulse position signal, the delay amount L, the index I and the gains δ, β and γ, or the delay amount L', the index I' and the gains β' and γ', and the selection signal so as to output to the multiplexer circuit 11b.

The multiplexer circuit 11b multiplexes the coded data outputted from the selecting circuit 13, and the LPC parameter outputted from the LPC analyzing circuit 2, and outputs the same.

The multiplexed data is transmitted via wire or wireless communication path, or stored in a storage device such as a memory, floppy disc and etc.

In addition, it is possible to reproduce the speech by applying the multiplexed data to the speech decoding unit shown in FIG. 4 of the first embodiment. In this case, since the decoding method is the same as the decoding method described in the first embodiment, a description thereof will be omitted here.

In addition, the bit allotment of the information utilized in the speech codec shown in FIG. 6 is shown in the following table 2.

TABLE 2

| | bit allotment (bit) | |
|---|---|---|
| LPC parameter information | 24 | |
| residual power information | 5 | |
| voiced sound/unvoiced sound information | 1 | |
| | voiced sound (bit) | unvoiced sound (bit) |
| pulse position information | 23 | — |
| adaptive code book information | 22 | 35 |
| noise code book information | 40 | 45 |
| gain information | 35 | 40 |

When such information are transmitted to the speech decoding unit shown in FIG. 4, the speech can be decoded and reproduced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A speech codec, comprising:

pitch extracting means for extracting a pitch-scale on the basis of a signal of an inputted speech;

voiced sound/unvoiced sound determinating means for determinating whether said inputted speech is one of a voiced sound speech and unvoiced sound speech on the basis of the signal of said inputted speech;

drive sound source generating means for generating a drive sound source signal on the basis of said pitch-scale and a determination result of said voiced sound/unvoiced sound determinating means, said drive sound source generating means including drive voiced sound source generating means for generating drive voiced sound source signal when said inputted speech is the voiced sound speech, and unvoiced sound source generating means for generating a drive unvoiced sound source signal when said inputted speech is the unvoiced sound speech, wherein said drive voiced sound source generating means includes pulse pattern generating means for generating a pulse pattern signal corresponding to said pitch-scale; first adaptive code book means for storing drive voiced sound source signals within a predetermined past time period; first noise code book means for storing in advance a noise signal; and first generating means for generating the drive voiced sound source signal on the basis of said pulse pattern signal, an output of said first adaptive code book means and an output of said first noise code book means;

speech synthesizing means for outputting a synthesized speech signal on the basis of one of said drive voiced sound source signal and said drive unvoiced sound source signal generated by said drive sound source generating means; and code outputting means for selectively outputting a code corresponding to one of said drive voiced sound source signal and said drive unvoiced sound source signal at a timing that an error between said synthesized speech signal and the signal of said inputted speech becomes minimum by comparing the synthesized speech signal and the signal of said inputted speech.

2. A speech codec according to claim 1, wherein said first generating means includes means for generating said drive voiced sound source signal by multiplying said pulse pattern signal, the output of said first adaptive code book means and the output of said first noise code book means by predetermined gains, respectively, and then by mixing the same.

3. A speech codec according to claim 1, wherein said first generating means selectively utilizes any one of said first drive voiced sound source signals stored in said first adaptive code book means within a time range of a predetermined number of the signals associated with said pitch-scale.

4. A speech codec according to claim 1, wherein said drive unvoiced sound source generating means includes second adaptive code book means for storing the drive unvoiced sound source signals within a predetermined past time period; second noise code book means for storing in advance a noise signal; and second generating means for generating the drive unvoiced sound source signal on the basis of an output of said second adaptive code book means and an output of said second noise code book means.

5. A speech codec according to claim 4, wherein said second generating means includes means for generating said drive unvoiced sound source signal by multiplying, the output of said second adaptive code book means and the output of said second noise code book means by predetermined gains, respectively, and then by mixing the same.

6. A speech codec according to claim 1, wherein said speech synthesizing means includes voiced sound speech synthesizing means for outputting a voiced sound synthesized speech signal on the basis of said drive voiced sound source, and unvoiced sound speech synthesizing means for outputting an unvoiced sound synthesized speech signal on the basis of said drive unvoiced sound source, and said speech codec further comprising means for outputting said determination result by said voiced sound/unvoiced sound determinating means together with said code.

7. A speech codec according to claim 1, wherein said pitch extracting means includes predictive residual signal outputting means for evaluating a predictive residual signal on the basis of the signal of said inputted speech, and extracts an interval between a preceding pitch pulse position of the drive sound source signal from a succeeding pitch pulse position at which an amplitude value of said predictive residual signal becomes larger than a predetermined value within a predetermined range in the vicinity of a position separated from the preceding pitch pulse position by said pitch-scale.

8. A speech codec according to claim 7, wherein said pitch extracting means includes predictive residual signal outputting means for evaluating a predictive residual signal on the basis of the signal of said inputted speech, and phase equalization means for phase-equalizing said predictive residual signal, and extracts an interval between a preceding pitch pulse position of said drive sound source signal from a peak position of said phase-equalized predictive residual signal as said pitch-scale.

9. A speech codec, comprising:

pitch extracting means for extracting pitch-scale on the basis of a signal of an inputted speech;

analyzing means for analyzing a parameter of said inputted speech;

first speech synthesizing means for synthesizing a voiced sound synthesized speech signal on the basis of said pitch-scale and said parameter, wherein said first speech synthesizing means includes pulse pattern generating means for generating a pulse pattern signal in response to said pitch-scale; first adaptive code book means for storing a drive voiced sound source signal within a predetermined past time period; first noise code book means for storing in advance a noise signal; and first generating means for generating said voiced sound synthesized speech signal on the basis of said pulse pattern signal, an output of said first adaptive code book means and an output of said first noise code book means;

second speech synthesizing means for synthesizing an unvoiced sound synthesized speech signal on the basis of the signal of said inputted speech and said parameter;

similarity determining means for determining that which one of said voiced sound synthesized speech signal and unvoiced sound synthesized speech signal is similar to said inputted speech;

selecting means for selecting one of said voiced sound synthesized speech signal and said unvoiced sound synthesized speech signal in response to an output of said similarity determining means; and multiplexer means for multiplexing one of said voiced sound synthesized speech signal and said unvoiced sound synthesized speech signal selected by said selecting means and said parameter.

10. A speech codec according to claim 9, wherein said analyzing means includes LPC analyzing means for outputting an LPC parameter of said inputted speech.

11. A speech codec according to claim 9, wherein said first generating means includes first mixing means for mixing said pulse pattern signal, said output of said first adaptive code book means and said output of said first noise code book means with multiplying the same by predetermined gains, respectively; and first synthesizing filter means for receiving an output of said first mixing means.

12. A speech codec according to claim 9, wherein said first generating means selectively utilizes any one of the past drive voiced sound source signals that are stored in said first adaptive code book means and exists within a time range in association with said pitch-scale.

13. A speech codec according to claim 9, wherein said second speech synthesizing means includes second adaptive code book means for storing a drive unvoiced sound source signal within a predetermined past time period; second noise code book means for storing in advance a noise signal; and second generating means for generating said unvoiced sound synthesized speech signal on the basis of an output of said second adaptive code book means and an output of said second noise code book means.

14. A speech codec according to claim 13, wherein said second generating means includes second mixing means for mixing said output of said second adaptive code book means and said output of said second noise code book means with multiplying the same by predetermined gains, respectively; and second synthesizing filter means for receiving an output of said second mixing means.

15. A speech codec according to claim 9, wherein said pitch extracting means includes predictive residual signal outputting means for evaluating a predictive residual signal on the basis of the signal of said inputted speech, and extracts an interval between a preceding pitch pulse position of said drive sound source signal from a succeeding pitch pulse position at which an amplitude value of said predictive residual signal becomes larger than a predetermined value within a predetermined range in the vicinity of a position separated from the preceding pitch pulse position by said pitch-scale.

16. A speech codec according to claim 15, wherein said pitch extracting means includes predictive residual signal outputting means for evaluating a predictive residual signal on the basis of the signal of said inputted speech, and phase equalization means for phase-equalizing said predictive residual signal, and extracts an interval between a preceding pitch pulse position of said drive sound source signal from a peak position of said phase-equalized predictive residual signal as said pitch-scale.

17. A speech codec according to claim 9, wherein said first speech synthesizing means includes pulse pattern generating means for generating a pulse pattern signal in response to said pitch-scale; first adaptive code book means for storing a drive voiced sound source signal within a predetermined past time period; first noise code book means for storing in advance a noise signal; and first generating means for generating said voiced sound synthesized speech signal on the basis of said pulse pattern signal, an output of said first adaptive code book means and an output of said first noise code book means.

18. A speech codec according to claim 17, wherein the drive voiced sound source data stored in said first adaptive code book is copied into said second adaptive code book when said voiced sound synthesized speech signal is selected by said selecting means, and the drive unvoiced sound source data stored in said second adaptive code book is copied into said first adaptive code book when said unvoiced sound synthesized speech signal is selected by said selecting means.

* * * * *